US005265954A

United States Patent [19]

Keil

[11] Patent Number: 5,265,954

[45] Date of Patent: Nov. 30, 1993

[54] REFRIGERATOR DOOR HINGE ASSEMBLY

[75] Inventor: John P. Keil, Ohio Township, Warrick County, Ind.

[73] Assignee: Whirlpool Corporation, Benton Harbor, Mich.

[21] Appl. No.: 312,723

[22] Filed: Feb. 21, 1989

[51] Int. Cl.[5] ..... A47B 81/00

[52] U.S. Cl. ..... 312/405; 312/326; 16/358; 16/360; 16/375

[58] Field of Search ..... 312/236, 116, 405, 326, 312/138.1, 296, 291; 16/358, 360, 375; 49/388

[56] References Cited

U.S. PATENT DOCUMENTS

| | | | |
|---|---|---|---|
| 874,528 | 12/1907 | McMullen . | |
| 1,400,788 | 12/1921 | Barrow . | |
| 1,864,163 | 6/1932 | Aldeen | 16/358 |
| 2,067,559 | 1/1937 | Bloom . | |
| 2,100,928 | 11/1937 | Way | 16/358 |
| 2,158,257 | 5/1939 | Sheehe . | |
| 2,181,025 | 11/1939 | Plotkin . | |
| 2,206,708 | 7/1940 | Stumpf | 16/358 |
| 2,560,860 | 7/1951 | Hannegan . | |
| 2,592,230 | 4/1952 | Allen . | |
| 2,597,174 | 5/1952 | Patton et al. . | |
| 2,799,888 | 7/1957 | White . | |
| 2,910,741 | 11/1959 | Dettman . | |
| 2,995,785 | 8/1961 | Hallenbeck . | |
| 3,083,403 | 4/1963 | Van Noord . | |
| 3,328,832 | 7/1967 | Simpson et al. | 16/249 |
| 3,368,237 | 2/1968 | Bierlich | 216/358 |
| 4,151,681 | 5/1979 | Roberts | 49/382 |
| 4,514,021 | 4/1985 | Sundermeier et al. | 312/291 |
| 4,609,234 | 9/1986 | Naniwa et al. | 312/296 |
| 4,725,107 | 2/1988 | Appleton | 312/116 |
| 4,736,491 | 4/1988 | Mertes | 16/360 |
| 4,774,740 | 10/1988 | Gidseg et al. | 16/344 |
| 4,864,691 | 9/1989 | Gidseg et al. | 312/138.1 |

FOREIGN PATENT DOCUMENTS

| | | | |
|---|---|---|---|
| 3202126 | 7/1983 | Fed. Rep. of Germany | 49/388 |
| 3242350 | 5/1984 | Fed. Rep. of Germany | 312/116 |
| 2517532 | 6/1983 | France | 312/116 |

*Primary Examiner*—Kenneth J. Dorner
*Assistant Examiner*—Brian K. Green
*Attorney, Agent, or Firm*—Wood, Phillips, VanSanten, Hoffman & Ertel

[57] ABSTRACT

An anti-pinch hinge assembly includes a hinge butt mounted to a refrigerator cabinet and having a generally planar section extending perpendicular to and outwardly from the cabinet. A planar hinge leaf is mounted to a cabinet door and is disposed in parallel relation with the hinge butt planar section. A pivot pin is included for pivotally mounting the hinge butt and hinge leaf to one another about a pivot axis disposed perpendicular to the hinge leaf and defining a gap between the hinge butt and the hinge leaf when the door is pivotally moved about, the axis. A gap cover is pivotally mounted to the pivot pin and is disposed between the hinge butt and the hinge leaf to cover the gap when the door is pivotally moved about the axis.

22 Claims, 3 Drawing Sheets

FIG. 1
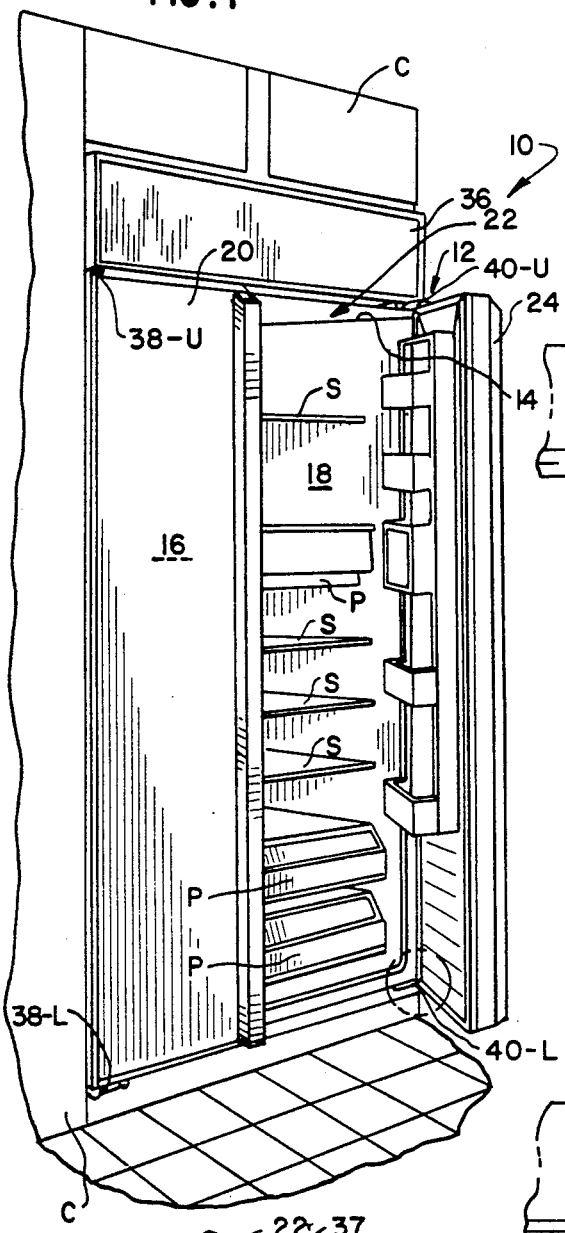
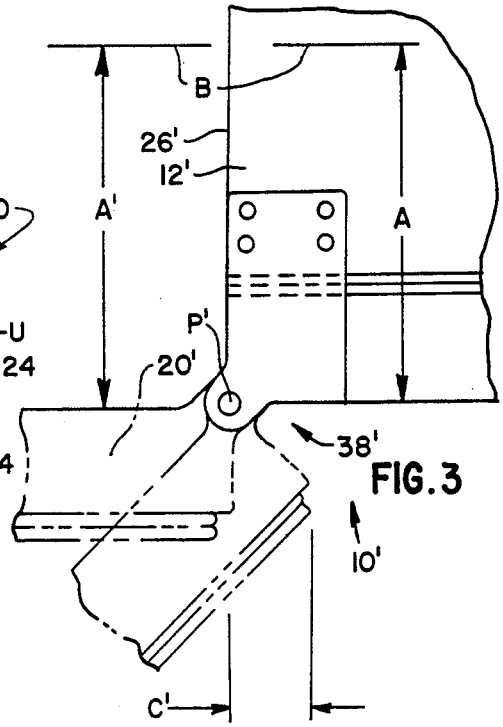
FIG. 3
FIG. 4
PRIOR ART
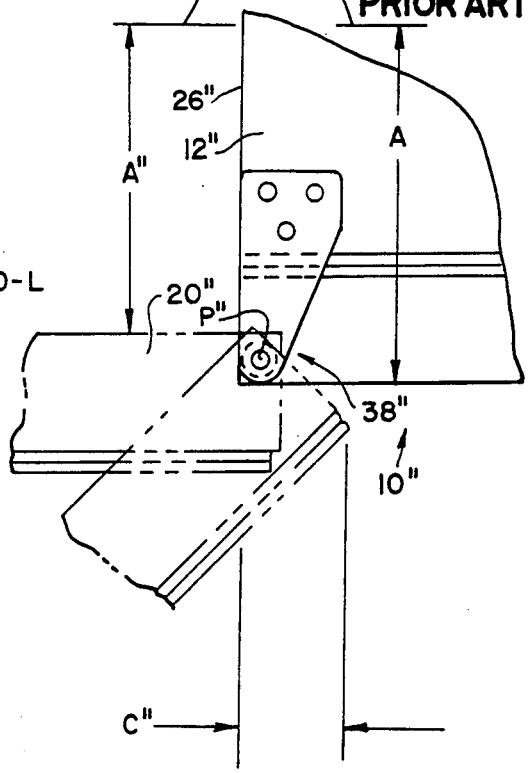
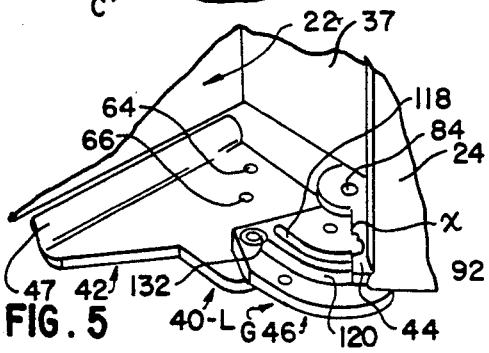
FIG. 5

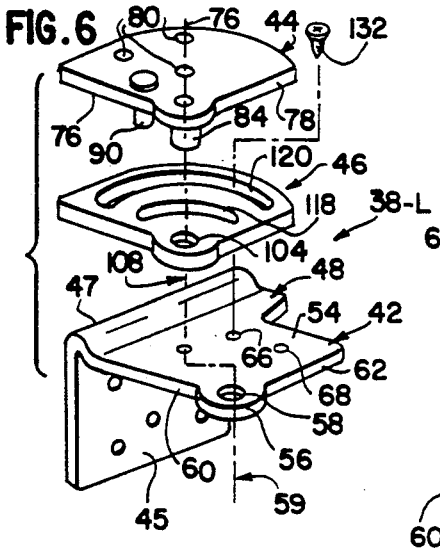
FIG. 6
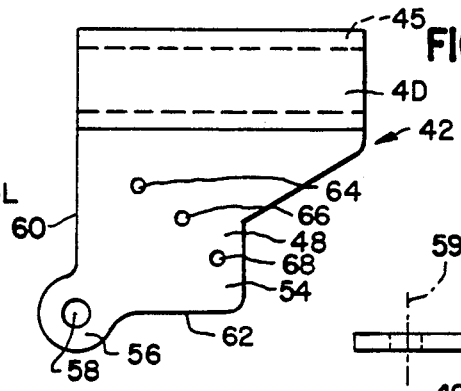
FIG. 7
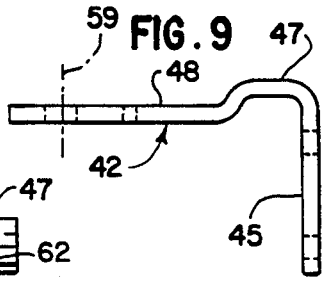
FIG. 9
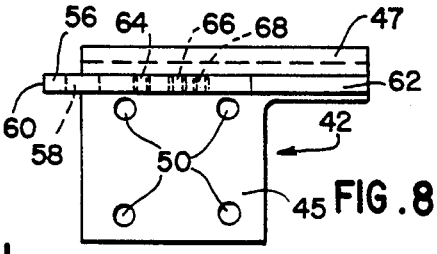
FIG. 8
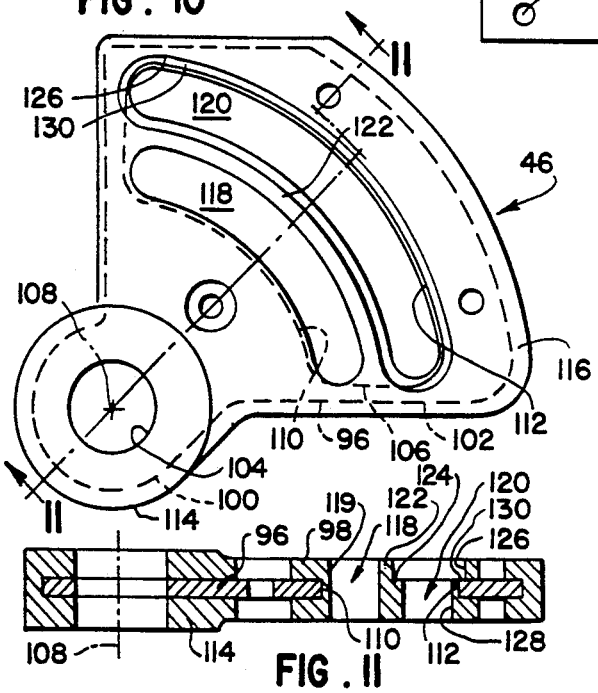
FIG. 10
FIG. 11
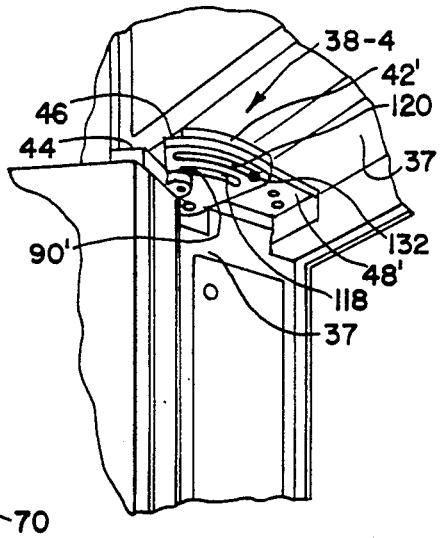
FIG. 14
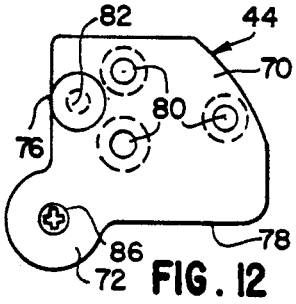
FIG. 12
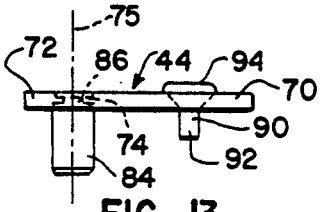
FIG. 13

REFRIGERATOR DOOR HINGE ASSEMBLY

BACKGROUND OF THE INVENTION

1. Field of the Invention

This invention relates generally to refrigerator cabinets, and more particularly, to an improved hinge assembly therefor.

2. Description of Background Art

Refrigerators typically include a cabinet having an internal storage space which is accessible through an access opening. The cabinet includes a door hingedly mounted thereto for selectively closing the access opening. Typically, such as is illustrated in Van Noord U.S. Pat. No. 3,083,403, the door is mounted to the cabinet utilizing an upper hinge and a lower hinge. Such hinges are provided with a pivotal axis located within the cross section of the door. Such a hinge presents a problem if a user desires to install the refrigerator with the front of the refrigerator flush with the front of adjacent cabinets. Specifically, the door would interfere with an adjacent cabinet if the user attempted to place the refrigerator flush with the cabinet.

Also, with such a pivot axis, and if the door open position is limited to, for example, ninety degrees, then it may be difficult to remove storage pans and baskets from the storage space due to the lack of clearance between such items and the door.

A further problem is presented with certain prior refrigerators relating to the potential for injury adjacent the hinge area. Often, the hinge comprises a hinge butt fastened to the cabinet and a hinge leaf attached to the cabinet door. The hinge leaf is pivotally mounted to the hinge butt utilizing a pivot pin. When the door is moved between the open position and the closed position injury can occur if a finger or the like is inadvertently placed in the hinge area between the hinge butt and the hinge leaf.

In some installations it may be desirable to limit the pivotal movement of the refrigerator door. For example, it may be desirable to limit pivotal movement to prevent the door from jarring cabinets or other appliances which could cause damage thereto. Nevertheless, since different installations call for different limits, it is necessary that the refrigerator be designed to satisfy each such installation.

The present invention is intended to overcome one or more of the problems as set forth above, in a novel and simple manner.

SUMMARY OF THE INVENTION

In accordance with one aspect of the invention, a refrigeration apparatus is provided with a hinge assembly which prevents scissoring action.

Broadly, there is disclosed herein a hinge assembly for pivotally mounting a door to a refrigeration apparatus cabinet. The hinge assembly includes a first bracket fixedly mounted to the cabinet having a generally planar section extending perpendicular to and outwardly from the cabinet. A second bracket is fixedly mounted to the door and has a generally planar section disposed in parallel relation with the first bracket planar section. Hinge means are included for pivotally mounting the first and second brackets to one another about a pivot axis. Anti-pinch means are mounted to the hinge means for preventing scissoring action of the hinge assembly.

It is a feature of the invention that the hinge means defines a pivotal axis which is coaxial with an outer corner of the door.

Specifically, according to the disclosed embodiment of the invention, each of the bracket planar sections includes an integral and outwardly projecting ear disposed at least partially outwardly of the door. The hinge means comprises an aperture through the first bracket ear and a pivot pin fastened to and extending perpendicular from the second bracket ear wherein the pivot pin is received in the aperture.

It is another feature of the invention that the anti-pinch means comprises a gap cover to prevent scissoring action between the two brackets.

The anti-pinch hinge assembly according to the invention includes a first bracket mounted to the cabinet having a generally planar section extending perpendicular to and outwardly from the cabinet. A planar second bracket is mounted to the door and is disposed in parallel relation with the first bracket planar section. Means are included for pivotally mounting the first and second brackets to one another about a pivot axis disposed perpendicular to the second bracket and defining a gap between the first and second brackets when the door is pivotally moved about the axis. A gap cover is pivotally mounted to the mounting means and is disposed between the first and second brackets and includes means operatively associated with the first and second brackets for causing the gap cover to cover the gap when the door is pivotally moved about the axis.

It is a feature of the invention that the gap cover includes a cam in cooperative engagement with a cam follower pin secured to the second bracket.

It is another feature of the invention that the gap cover includes a cam in cooperative engagement with a cam follower pin secured to the first bracket planar section.

It is still a further feature of the invention that the gap cover comprises a metal plate enclosed in a molded jacket. The jacket may be made of polymer construction and may include a lubricant facilitating pivotal movement of the gap cover.

It is yet another feature of the invention that the cam follower pin is secured to the first bracket planar section at a location to provide a selected maximum door opening angle.

It is an additional feature of the invention that the can follower pin is secured to the first bracket planar section at one of a plurality of positions to provide a selectable maximum door opening angle.

According to a still further aspect of the invention, an adjustable stop hinge assembly is provided for a refrigeration apparatus.

According to this further aspect of the invention, the hinge assembly includes a first bracket mounted to the cabinet and having a generally planar section extending perpendicular to and outwardly from the cabinet. A planar second bracket is mounted to the door and is disposed in parallel relation with the first bracket planar section. Means are included for pivotally mounting the first and second brackets to one another about a pivot axis disposed perpendicular to the second bracket. A cam is pivotally mounted to the mounting means and is disposed between the first and second brackets and includes means operatively associated with the first and second brackets for limiting pivotal movement between the first and second brackets.

Further features and advantages of the invention will readily be apparent from the specification and from the drawings.

BRIEF DESCRIPTION OF THE DRAWINGS

FIG. 1 is a perspective view of a refrigerator having a hinge assembly embodying the invention;

FIG. 3 is a plan view of a portion of a refrigerator including a hinge assembly embodying one aspect of the invention illustrating a cabinet door in various positions;

FIG. 4 is a view similar to that of FIG. 3 for a prior refrigerator hinge assembly;

FIG. 5 is a more detailed perspective view of the lower right hinge assembly of the refrigerator of FIG. 1;

FIG. 6 is an exploded view of the lower left hinge assembly of the refrigerator of FIG. 1;

FIG. 7 is a plan view of a hinge butt of the hinge assembly of FIG. 6;

FIG. 8 is a front elevation view of the hinge butt of FIG. 7;

FIG. 9 is a side elevation view of the hinge butt of FIG. 7;

FIG. 10 is a plan view of a gap cover of the hinge assembly of FIG. 6;

FIG. 11 is a sectional view taken along the line 11—11 of FIG. 10,

FIG. 12 is a plan view of a hinge leaf of the hinge assembly of 6;

FIG. 13 is a side elevation view of the hinge leaf of FIG. 12; and

FIG. 14 is a detailed perspective view of the upper left hinge assembly for the refrigerator of FIG. 1.

DETAILED DESCRIPTION OF THE INVENTION

Figure 2:
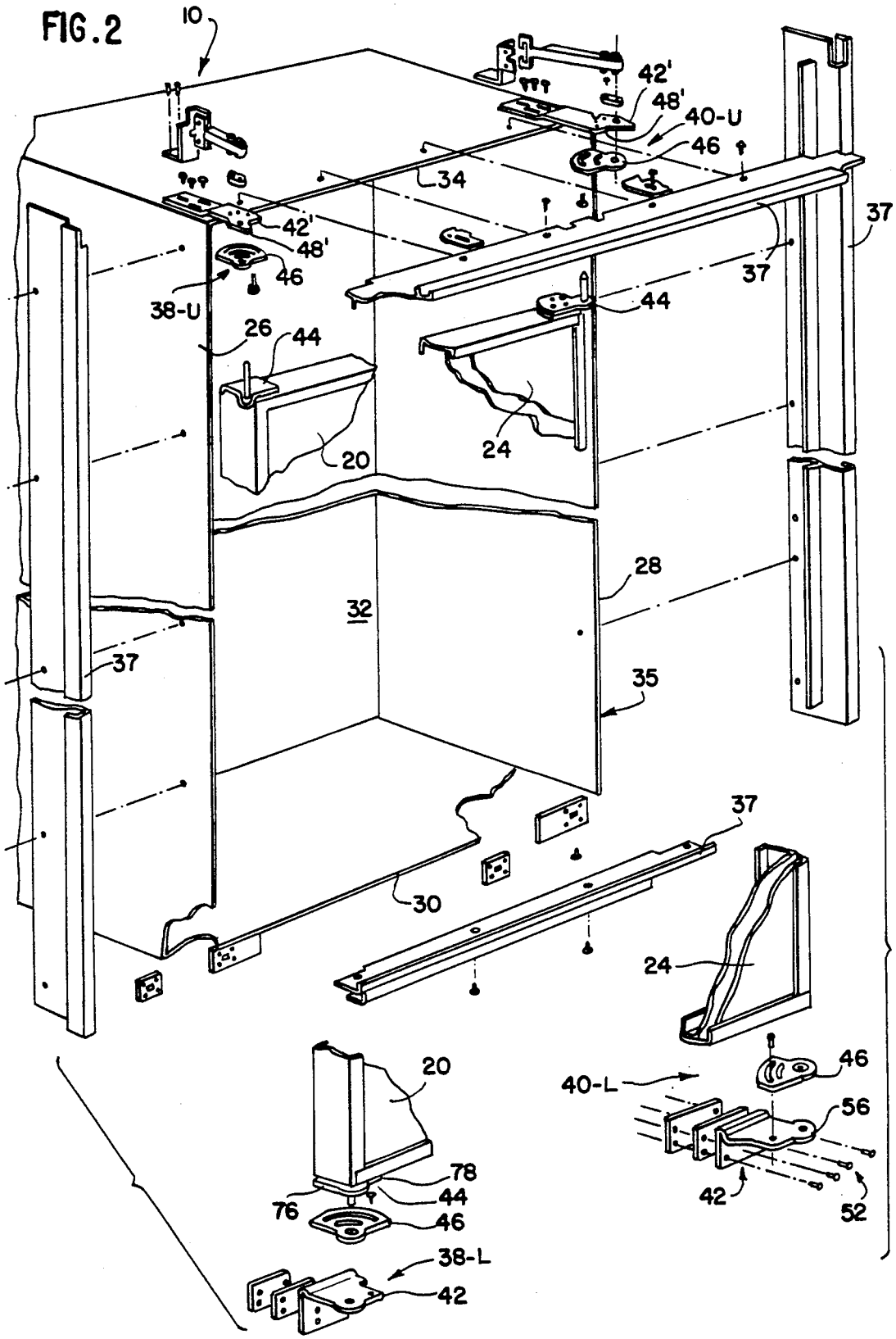
FIG. 2 is a partially cut-away, exploded view of the refrigerator of FIG. 1, with certain parts removed for clarity, specifically illustrating the installation of the hinge assembly.

Referring to FIG. 1, a refrigeration apparatus, such as a refrigerator/freezer 10, includes a hinge assembly according to the present invention. The invention is shown utilized with a built-in, side-by-side refrigerator/freezer; however, other types of refrigeration apparatus may be used in conjunction with the hinge assembly of the present invention, as will be obvious to those skilled in the art.

The refrigerator/freezer 10 includes a cabinet 12 provided with an internal liner 14 and an insulating separator or divider wall (not shown) to define a below-freezing, or freezer, compartment 16 and a fresh food, or above-freezing, compartment 18. Each of the compartments 16 and 18 comprises a storage space including selected shelves S and storage pans P as is well known.

The freezer compartment 16 is accessible through an access opening (not shown). A freezer door 20 is provided for selectively closing the freezer access opening. Similarly, the fresh food compartment 18 includes an access opening 22 and a fresh food door 24 is provided for selectively closing the fresh food access opening 22.

With reference also to FIG. 2, the refrigerator/-freezer 10 includes first and second opposite side walls 26 and 28, a bottom wall 30, a back wall 32 and a top wall 34, defining an outer shell indicated generally at 35. The outer shell 35 may be, for example, of sheet metal construction. Although not specifically illustrated, means are included for installing the liner 14 within the shell 35 with a suitable foamed insulation included therebetween, as is well known.

As illustrated in FIG. 1, the refrigerator/freezer 10 is adapted to be mounted flush with and immediately adjacent to cabinets C. In fact, the front face of the freezer door 20 and fresh food door 24 may be provided with inserts for matching the face of the cabinet C. Also, a trim piece 36 extends upwardly from the cabinets 12 to conceal conventional refrigeration connected components, such as a compressor and the like (not shown) installed superjacent the top wall 34.

Suitable upper, lower and side trim pieces 37 are fastened to the shell 35 by any known means and serve to provide a front decoration for the cabinet and/or to support side decorative panels as is well known.

The refrigeration apparatus includes upper and lower hinge assemblies 38-U and 38-L for pivotally mounting the freezer door 20 to the shell 35. Similarly, upper and lower hinge assemblies 40-U and 40-L are provided for pivotally mounting the fresh food door 24 to the shell 35. As will be appreciated, the upper hinge assemblies 38-U and 40-U are generally similar in construction, albeit mirror images of one another. Likewise, the lower hinge assemblies 38-L and 40-L are mirror images of one another. However, the upper hinge assemblies indicated by the U suffix are different from the lower hinge assemblies, indicated by the suffix L, as described hereinbelow.

As illustrated in FIG. 1, it may be desirable in certain applications for the front face of the doors 20 and 24 to be flush mounted with the front face of adjacent cabinets C. However, this situation can present a problem if it is also desirable to open the refrigerator doors more than ninety degrees. Specifically, referring to FIGS. 3 and 4, the operation of a hinge assembly 38', see FIG. 3, according to one aspect of the invention is compared to that of a typical prior art hinge assembly 38", see FIG. 4.

Specifically, the prior hinge assembly 38" secures a cabinet door 20" to a cabinet 12". The hinge assembly 38" includes a pivot pin P" defining a pivot axis which is inside the cross section of the door 20". Instead, the hinge assembly 38' according to the one aspect of the invention includes a pivot pin P' defining a pivot axis coaxial with a front edge corner of the door 20'.

As illustrated in FIGS. 3 and 4, with either respective door 20' or 20" in a closed position, the front face of each door 20' and 20" is a distance A from a preselected location, indicated by a line B, rearwardly thereof. When the door 20' of FIG. 3 is moved to the 180 degree open position its front face is a distance A' from the line B. The distance A' is equivalent to the distance A, providing a flush mount design. As the prior art door 20" swings to a 180 degree open position, the front face of the door 20" is a distance A", which is less than the distance A, from the line B. Therefore, the prior art cabinet 10" incorporating the hinge assembly 38" could not be flush mounted with adjacent cabinets. This result is due to the fact that the front door 20" would strike adjacent cabinets, as evidenced by the distance A" being less than the distance A, if the door 20" is opened more than ninety degrees.

Additionally, with the respective doors 20' and 20" in a partially opened disposition, e.g., 135 degrees, a distance C' from a side wall 26' to the innermost point of the cabinet door 20' is less than a similarly determined distance C" for the cabinet 10" of FIG. 4. Such a smaller dimension is desirable in that it creates additional clearance between the door and any movable storage pans or baskets which are moved outward from within the compartment. In installations where door opening movement is limited, the extra clearance allows easier removal of storage pans and baskets.

As discussed above, the lower hinge assemblies 8-L and 40-L are identical in construction other than being mirror images of one another. FIG. 5 illustrates a detailed perspective view of the lower right hinge assembly 40-L; while FIG. 6 illustrates the lower left hinge assembly 38-L in exploded view. Since the elements of each are identical, common reference numeral will be used throughout, it being understood that the precise location of any specific element is determined according to whether the hinge is for the left side or the right side, as will be obvious to those skilled in the art.

The purpose for the hinge assemblies 38 and 40 is to provide a mechanism for pivotal movement of the doors 20 and 24 to open the same, which movement minimizes opportunities for injury and also limits the range of door rotation.

Each of the lower hinge assemblies 38-L and 40-L includes a first bracket, or hinge butt 42, a second bracket, or hinge leaf 44, and a gap cover 46.

Referring also to FIGS. 7-9, the hinge butt 42 may be, for example, of chrome plated steel single piece construction. The hinge butt 42 includes a planar fastening section 45 extending to an outwardly turned shoulder section 47 further extending through an S turn to a planar support section 48. The fastening section 45 includes a plurality of apertures 50 through which suitable fasteners 52, see FIG. 2, may be inserted for fastening the hinge butt 42 to the shell 35. The support section 48 diverges outwardly to a generally rectangular shaped distal portion 54 having an integral outwardly projecting ear 56 extending diagonally from a corner thereof. A pivot aperture 58 extends through the ear 56. In the illustrative embodiment, the aperture 58 is circular in shape and includes a central axis, indicated by a a dashed line 59, coplanar with a side edge 60 and a front edge 62 of the support section 48.

First, second and third threaded apertures 64, 66 and 68 pass through the support section 48. Each of the threaded apertures 64, 66 and 68 are equally spaced from the axis 59. The spacing of each of the threaded apertures 64, 66 and 68 from the front edge 62 is determined to provide a preselected limit of range of door rotation, as is described more specifically below.

Referring to FIGS. 12 and 13, the hinge leaf 44 includes a generally planar plate 70 preferably of chrome plated metal construction. The plate 70 is generally rectangular in shape and includes an integral outwardly projecting ear 72 corresponding to the hinge butt ear 56. A circular pivot aperture 74, see FIG. 13, extends through the ear 72. The aperture 74 has a central axis,, indicated by a dashed line 75, coplanar with a side edge 76 and a front edge 78 of the plate 70. The plate 70 includes a plurality of apertures 80 through which suitable fasteners may be inserted for fastening the hinge leaf 44 to the cabinet door. A cam follower aperture 82 also extends through the plate 70 adjacent and centrally located relative to the side edge 76. The aperture 82 is spaced a distance from the pivot aperture 74, a distance less than the distance provided between the hinge butt threaded apertures 64, 66 and 68 relative to the hinge butt pivot aperture 58.

A cylindrical pivot pin 84 has a diameter greater than the diameter of the pivot aperture 74 and narrows at an upper end 86. The upper end 86 is sized to fit through the pivot aperture 74 and is inserted upwardly therethrough. The pivot pin 84 is staked to the plate 70 as by deforming the upper end 86 as is well known. Alternatively, other means for fastening the pivot pin 84 to the plate 70, such as a threaded connector, may also be utilized. A cam follower pin 90 includes a cylindrical narrow body 92 with a diameter slightly less than the diameter of the aperture 82, and an enlarged head 94. The follower pin 90 extends downwardly through the aperture 82 and is secured therein by any known means.

Referring also to FIGS. 10 and 11, the gap cover 46 comprises a metal plate 96 enclosed in a molded jacket 98. The jacket 98 may be of polymer construction and may advantageously include a lubricant for facilitating pivotal movement of the gap cover as discussed below.

A metal plate is utilized for part strength and to support the jacket 98 which provides the lubricated bearing surfaces between the hinge butt 42 and the hinge leaf 44. The polymer jacket is utilized to eliminate a "clicking" sound which can occur when the door is opened or closed. Without the jacket, this sound would be caused by the striking of the pins 90 and 132 on the gap cover 46 when the door is moved, as discussed below.

The plate 96 is generally planar and includes an ear 100 integral with and extending outwardly from a cam section 102. The cam section 102 is generally in the shape of a partial, quarter circle, similar to that of the plate 70, see FIG. 12. The ear 100 includes a circular pivot aperture 104 therethrough. The aperture 104 is of a size similar to the hinge butt pivot aperture 58, discussed above relative to FIGS. 7-9. An elongated arcuate aperture 106 extends through the follower section 102. Specifically, the slot 106 forms an arc radially spaced from a central axis, indicated S, a dashed line 108, of the pivot aperture 104. An inner edge 110 of the slot 106 is spaced a distance less than the spacing between the hinge leaf pivot aperture 74 and its follower pin opening 82. An outermost edge 112 of the slot 106 is radially spaced a distance greater than the radial spacing between the hinge butt pivot aperture 58 and the threaded apertures 64, 66 and 68.

The jacket 98 is molded around the plate 96 and includes an ear section 114 corresponding in size and shape to the hinge butt ear section 56, see FIG. 7, and the hinge leaf ear section 72, see FIG. 12. The jacket 98 also includes a cam follower section 116 which is similar in shape, albeit slightly larger than, the plate cam follower section 102. The ear section 114 of the jacket is of a slightly greater depth than is the jacket cam follower section 116.

The jacket cam follower section 116 includes first and second arcuate slots 118 and 120 passing therethrough. The slots 118 and 120 are separated by a central wall 122. The first slot 118 includes an inner wall 119 which completely encloses the edge 110 of the plate slot 106 and extends in a radial arc about the pivot axis 108. The spacing of the slot 118 from the axis 108 corresponds to the spacing of the hinge leaf 44 between the pivot aperture 74 and the cam follower pin aperture 82. The central wall 122 includes a shoulder 124. The slot 120 includes a radial outer, upper wall 126 above the metal plate 96 which is spaced from the pivot axis 108 a distance greater than the plate edge 112. A radial outer, lower wall 128 is spaced a distance less than that of the plate wall 112. As a result, the edge 112 is covered by the jacket wall 128. However, the upper surface of the plate 96 adjacent the edge 112 is slightly exposed and defines a shoulder 130.

The radial spacing from the axis 108 to the second slot 120 corresponds to the radial spacing of the hinge butt between the pivot aperture 58 and the threaded apertures 64, 66 and 68.

During the cabinet assembly process, the hinge butt 42 is fastened to the cabinet shell 35, as discussed above. The gap cover 46 is then placed on top of the hinge butt support section 48 with the respective pivot aperture axes 59 and 108 aligned, as illustrated in exploded view in FIG. 6. Also, the second slot 120 is positioned in overlying relationship with the threaded apertures 64, 66 and 68. Thereafter, a threaded fastening element, such as a screw 132, see FIG. 6, is inserted through the second slot 120 and is threaded into a selected one of the threaded apertures 64, 66 or 68. The screw 132 has an enlarged head which of a size larger than the lower portion of the second slot 120 but enough smaller to rest on the shoulders 124 and 130 therein. The slot 120 acts as a cam with the screw 132 serving as a cam follower pin to limit the range of pivotal movement of the gap cover 46 relative to the hinge butt 42.

The hinge leaf 44 is fastened to the underside of the cabinet door as is apparent from the illustrations of both FIG. 2 and FIG. 5. Particularly, the hinge leaf 44 is positioned so that the side edge 76 and front edge 78 are parallel to similar edges of the door. In the illustrative embodiment, the side edge 76 is positioned outwardly from the side edge of the door 24. The front edge 78 may be flush with the front of the door, as shown in FIG. 2, or spaced outwardly therefrom. Resultantly, the pivot pin 84 is disposed substantially outwardly of the cross section of the door. More specifically, the pivot axis 75 is positioned coaxial with the front corner of the door, or, alternatively, outwardly therefrom.

With the hinge leaf 44 so installed, the door is mounted on the cabinet as by inserting the pivot pin 84 downwardly through both the gap cover pivot aperture 104 and the hinge butt pivot aperture 58. Also, the hinge leaf cam follower pin 90 extends downwardly through the gap cover first slot 118 but does not come into contact with the hinge butt support section 48.

If the door is in the closed position, then the hinge leaf 44, the gap cover 46, and the hinge butt support section 48 are in substantial alignment as is generally illustrated in FIG. 6. When the door 24 is pivoted to open the access opening 22 the cam follower pin 90 slides in the first slot 118 of the gap cover 46. Once the pin slides through the extent of the first slot 118, then a butting engagement of the pin 90 with the slot 118 causes the gap cover 46 to pivot about the axis 108. The motion generated in the gap cover 46 is such that any opening in a void, or gap G, see FIG. 5, between the door hinge leaf 44 and the hinge butt support section 48 is always covered, or spanned, by the gap cover 46. This provides anti-pinch protection as by eliminating the potential of injury due to any scissoring action of the hinge leaf 44 and hinge butt support section 48. As the gap cover is further rotated, the second slot 120 slides past the screw 132 which in this sense serves as a cam follower pin itself. Rotation continues until the screw 132 abuts the end of the second slot 120, as is specifically illustrated in FIG. 5, to stop further movement of the door.

As is apparent from the above, depending upon which threaded aperture 64, 66 or 68 the screw 132 is inserted, the second slot 120 abuts the screw 132 at a different angular position. As a result, a user can adjust the range of movement of the door as by adjusting the position of the screw 132. In the illustrative example the apertures 64, 66 and 68 are positioned to permit door opening movement of 90, 135 and 180 degrees, respectively.

Referring again to FIG. 2, the upper hinge assemblies 38-U and 40-U include a hinge leaf 44, similar to the hinge leaf discussed above relative to FIGS. 12 and 13, which is fastened to the top of the respective doors 20 and 24. A gap cover 46 is also provided for each such hinge assembly. The hinge assemblies 38-U and 40-U differ from the corresponding lower hinge assemblies 38-L and 40-L in that an upper hinge butt 421 comprises a generally planar metal bracket which is fastened to the shell top wall 34. Each hinge butt 42' includes a support section 48' corresponding to the support section 48 of the hinge butt 42.

With reference to FIG. 14, it can be seen that the operation of the upper hinge assembly 38-U is similar to that for the lower hinge assemblies. In the illustration, the cam follower pin 90 is removed for clarity but is represented schematically by the line 90'. Otherwise operation is similar to that for the lower hinges where the gap cover 46 serves to fill the opening between the hinge leaf 44 and the hinge butt 42' as it is drawn by the cam follower pin 90, and the hinge butt cam follower pin 132 serves to act as a stop to limit pivotal movement of the door.

As is apparent, the hinge butt cam follower pin 132 for both the upper and lower hinge assembly of either door should be placed in the same position. However, it is not necessary that both doors 20 and 24 be configured for the same limited movement.

Thus, the invention broadly comprehends a hinge assembly for a refrigeration apparatus which permits the refrigerator cabinet door to be flush mounted with adjacent cabinets, minimizes the opportunity for injury, and provides selective limits for the range of door rotation.

The foregoing disclosure of the exemplary embodiment is illustrative of the broad inventive concepts comprehended by the invention.

I claim:

1. In a flush mounted refrigeration apparatus including a cabinet having an internal storage space accessible through an accessible opening and a door for selectively closing said access opening, said door being generally rectangular in cross section and having a front wall, an anti-pinch hinge assembly for pivotally mounting said door to said cabinet to permit said refrigeration apparatus to be mounted with said front wall flush with adjacent cabinet fronts, comprising:

a hinge butt fixedly mounted to said cabinet and having a generally planar section extending perpendicular to and outwardly from said cabinet access opening;

a hinge leaf fixedly mounted to said door and having a generally planar section disposed in parallel relation with said hinge butt planar section;

hinge means coupled to said hinge butt and said hinge lead for pivotally mounting said hinge butt and hinge leaf to one another about a pivot axis disposed perpendicular to said planar sections and immediately adjacent said front wall, said pivotal hinge means being disposed at least partially outwardly of the cross section of said door; and an anti-pinch cover mounted to said hinge means spanning a gap in a plane parallel to said planar sections between said hinge butt and hinge leaf to prevent injury caused by scissoring action of said hinge butt and hinge leaf, wherein each of said hinge butt and hinge leaf planar sections includes an integral outwardly projecting ear disposed at least partially outwardly of the cross section of said door, wherein said hinge means comprises an aperture through the outwardly projecting ear of said hinge butt planar section and a pivot pin fastened to and extending perpendicular from said hinge leaf planar section ear and being received in said aperture.

2. In a refrigeration apparatus including a cabinet having an internal storage compartment accessible through an access opening and a door for selectively closing said access opening, a hinge assembly comprising:

a first bracket mounted to said cabinet and having a generally planar section extending perpendicular to and outwardly from said cabinet;

a planar second bracket mounted to said door and disposed in parallel relation with said first bracket planar section;

means for pivotally mounting said first and second brackets to one another about a pivot axis disposed perpendicular to said second bracket; and a cam pivotally mounted to said mounting means and disposed between said first and second brackets and including means operatively associated with said first and second brackets for limiting pivotal movement between said first and second brackets, wherein said cam includes a slot in cooperative engagement with a cam follower pin secured to said second bracket.

3. In a refrigeration apparatus including a cabinet having an internal storage compartment accessible through an access opening and a door for selectively closing said access opening, a hinge assembly comprising:

a first bracket mounted to said cabinet and having a generally planar section extending perpendicular to and outwardly from said cabinet;

a planar second bracket mounted to said door and disposed in parallel relation with said first bracket planar section;

means for pivotally mounting said first and second brackets to one another about a pivot axis disposed perpendicular to said second bracket; and a cam pivotally mounted to said mounting means and disposed between said first and second brackets and including means operatively associated with said first and second brackets for limiting pivotal movement between said first and second brackets, wherein said cam includes a slot in cooperative engagement with a cam follower pin secured to said first bracket planar section.

4. The hinge assembly of claim 3 wherein said cam follower pin is secured to said first bracket planar section at a location to provide a selected maximum door opening angle.

5. The hinge assembly of claim 3 wherein said cam follower pin is secured to said first bracket planar section at one of a plurality of positions to provide a selectable maximum door opening angle.

6. In a refrigeration apparatus including a cabinet having an internal storage space accessible through an access opening, a door, and a hinge assembly for pivotally mounting said door to said cabinet for movement between a) an open position in which the storage space is accessible through the access opening and b) a closed position, said hinge assembly comprising:

a first bracket fixedly mounted to said cabinet and having a generally planar section extending perpendicular to and outwardly from said cabinet;

a second bracket fixedly mounted to said door and having a generally planar section disposed in parallel relation with said first bracket planar section;

hinge means for pivotally mounting said first and second brackets to one another about a pivot axis disposed perpendicular to said planar sections;

an anti-pinch mechanism; and means for mounting the anti-pinch mechanism to the hinge means and for preventing injury caused by a scissoring action a) between the first and second brackets and b) the anti-pinch mechanism and each of the first and second brackets throughout the range of movement of the door between its open and closed positions.

7. The hinge assembly of claim 6 wherein said anti-pinch mechanism comprises a cam pivotally mounted to said hinge means.

8. The hinge assembly of claim 6 wherein said anti-pinch mechanism is disposed between said first and second bracket planar sections.

9. In a flush mounted refrigeration apparatus including a cabinet having an internal storage space accessible through an access opening, and, a door, said door being generally rectangular in cross section and having a front wall, a hinge assembly for pivotally mounting said door to said cabinet for movement between a) an open position in which the storage space is accessible through the access opening and b) a closed position and to permit said refrigeration apparatus to be mounted with said front wall flush with adjacent cabinet fronts, comprising:

a hinge butt fixedly mounted to said cabinet and having a generally planar section extending perpendicular to and outwardly from said cabinet access opening;

a hinge leaf fixedly mounted to said door and having a generally planar section disposed in parallel relationship with said hinge butt planar section;

hinge means coupled to said hinge butt and said hinge leaf for pivotally mounting said hinge butt and hinge leaf to one another about a pivot axis disposed perpendicular to said planar sections and immediately adjacent said front wall, said pivotal hinge means being disposed at least partially outwardly of the cross section of said door;

an anti-pinch mechanism; and means for mounting the anti-pinch mechanism to at least one of the hinge means, hinge butt and hinge leaf and for preventing injury caused by a scissoring action a) between the hinge butt and hinge leaf and b) the anti-pinch mechanism and each of the hinge butt and hinge leaf throughout the range of movement of the door between its open and closed positions.

10. The hinge assembly of claim 9 wherein said hinge means comprises an aperture through said hinge butt planar section and a pivot pin fastened to and extending perpendicular from said hinge leaf planar section and being received in said aperture.

11. The hinge assembly of claim 9 wherein each of said hinge leaf and hinge butt planar sections includes an integral outwardly projecting ear disposed at least partially outwardly of the cross section of said door.

12. An anti-pinch hinge assembly for a refrigeration apparatus including a cabinet having an internal storage compartment accessible through an access opening and a door that is selectively movable between a) an open position in which the storage compartment is accessible through the access opening and b) a closed position wherein the door blocks said access opening, said hinge assembly pivotally mounting said door to said cabinet, said hinge assembly comprising:

a first bracket mounted to said cabinet and having a generally planar section extending perpendicular to and outwardly from said cabinet and having a first edge;

a planar second bracket mounted to said door, disposed in parallel relationship with said first bracket planar section and having a second edge;

means for pivotally mounting said first and second brackets to one another about a pivot axis disposed perpendicular to said second bracket so that said first and second edges move one over the other in a scissoring action as the door moves from its open to its closed position; and a gap cover pivotally mounted to said mounting means and disposed between said first and second brackets and including first means extending between said first and second edges at locations spaced away from the pivot axes for the brackets for preventing injury caused by a scissoring action both between a) the first and second edges and b) the first means and either of the first and second bracket edges through the range of pivoting of the door between its open and closed positions.

13. The hinge assembly of claim 12 wherein said gap cover includes a cam in cooperative engagement with a cam follower pin secured to said second bracket.

14. The hinge assembly of claim 12 wherein said gap cover includes a cam in cooperative engagement with a cam follower pin secured to said first bracket planar section.

15. The hinge assembly of claim 14 wherein said cam follower pin is secured to said first bracket planar section at a location to provide a selected maximum door opening angle.

16. The hinge assembly of claim 14 wherein said cam follower pin is secured to said first bracket planar section at one of a plurality of positions to provide a selectable maximum door opening angle.

17. The hinge assembly of claim 13 wherein said gap cover comprises a metal plate enclosed in a molded jacket.

18. The hinge assembly of claim 17 wherein said jacket is of polymer construction and includes a lubricant facilitating pivotal movement of said gap cover.

19. In a refrigeration apparatus including a cabinet having an internal storage compartment accessible through an access opening, said door being selectively movable between a) an open position wherein the storage compartment is accessible through the access opening and b) a closed position for blocking said access opening, an anti-pinch hinge assembly for pivotally mounting said door to said cabinet comprising:

a hinge butt fixedly mounted to said cabinet and having a generally planar section extending perpendicular to and outwardly from said cabinet and a first edge;

a hinge leaf fixedly mounted to said door and having a generally planar section extending perpendicular to and outwardly from said cabinet and a second edge;

pivotal hinge means for pivotally mounting said hinge butt and said hinge leaf to one another about a pivot axis disposed perpendicular to said planar sections, and wherein said planar sections are in overlapping relationship when said door is closed and are disaligned otherwise to provide a void between the first and second edges which move in a scissoring action as the door is moved between its open and closed positions; and a cam pivotally mounted to said hinge means and disposed between said planar sections and including means operatively associated with said hinge butt and said hinge leaf for causing said cam to substantially fill said void through the range of movement of the door between its open and closed positions to thereby provide anti-pinch protection for said hinge assembly.

20. A hinge assembly for a refrigeration apparatus including a cabinet having an internal storage compartment accessible through an access opening and a door for selectively closing said access opening, comprising:

a first bracket mounted to said cabinet and having a generally planar section extending perpendicular to and outwardly from said cabinet;

a planar second bracket mounted to said door and disposed in parallel relation with said first bracket planar section;

means for pivotally mounting said first and second brackets to one another about a pivot axis disposed perpendicular to said second bracket; and a cam pivotally mounted to said mounting means and disposed between said first and second brackets and including means operatively associated with said first and second brackets for limiting pivotal movement between said first and second brackets, there being a pin and slot connection between the cam and at least one of the first and second brackets.

21. The hinge assembly of claim 20 wherein said cam comprises a metal plate enclosed in a molded jacket.

22. The hinge assembly of claim 21 wherein said jacket is of polymer construction and includes a lubricant facilitating pivotal movement of said cam.

* * * * *